United States Patent [19]

Deutschmann

[11] Patent Number: 4,860,716

[45] Date of Patent: Aug. 29, 1989

[54] MULTI-CYLINDER DIESEL INTERNAL COMBUSTION ENGINE WITH LOW COMPRESSION RATIO IN THE CYLINDERS

[75] Inventor: Herbert Deutschmann, Friedrichshafen, Fed. Rep. of Germany

[73] Assignee: Mtu-Motoren und Turbinen Union, Friedrichshafen, Fed. Rep. of Germany

[21] Appl. No.: 214,714

[22] PCT Filed: Jul. 3, 1987

[86] PCT No.: PCT/DE87/00302

§ 371 Date: May 3, 1988

§ 102(e) Date: May 3, 1988

[87] PCT Pub. No.: WO88/02065

PCT Pub. Date: Mar. 24, 1988

[30] Foreign Application Priority Data

Sep. 13, 1986 [DE] Fed. Rep. of Germany ..... 3631284

[51] Int. Cl.[4] ..... F02D 17/02; F02B 33/02

[52] U.S. Cl. ..... 123/560; 123/198 F

[58] Field of Search ..... 123/198 F, 559.1, 560

[56] References Cited

U.S. PATENT DOCUMENTS 4,248,198 2/1981 Deutschmann et al. ..... 123/559.1

FOREIGN PATENT DOCUMENTS 2838682 3/1980 Fed. Rep. of Germany ... 123/198 F 2838683 3/1980 Fed. Rep. of Germany ... 123/198 F 2093909 9/1982 United Kingdom ..... 123/198 F

*Primary Examiner*—Michael Koczo

*Attorney, Agent, or Firm*—Barnes & Thornburg

[57] ABSTRACT

During the starting and possibly at partial load, the diesel internal combustion engine operates in the so-called divided operation, whereby some cylinders (7 to 12) operate without fuel supply as compressors and supply compressed air to the cylinders (1 to 6) operating as engine. For example, the compressor cylinder (8) is connected with the engine cylinder (5) by way of a line (13) independent of the customary suction and exhaust lines, which includes at its one end in the proximity of the compressor cylinder (8) a donor valve (22) adapted to be controllably opened in the divided operation and at its other end in the proximity of the engine cylinder (5) a receiver valve (23). Each of the receiver valves (23) is combined with a device for the opening at will of the respectively associated line (13) in the direction of the compressor cylinder (14), whereby the opening control of the lines (13) by the devices takes place during the exhaust stroke of the coordinated engine cylinder (16). An exhaust gas return from the engine cylinders (1 to 6) to the compressor cylinders (7 to 12) is attained thereby and a temperature increase in the compressor cylinders is achieved with divided operation of the diesel internal combustion engine.

6 Claims, 1 Drawing Sheet

Figure 1:
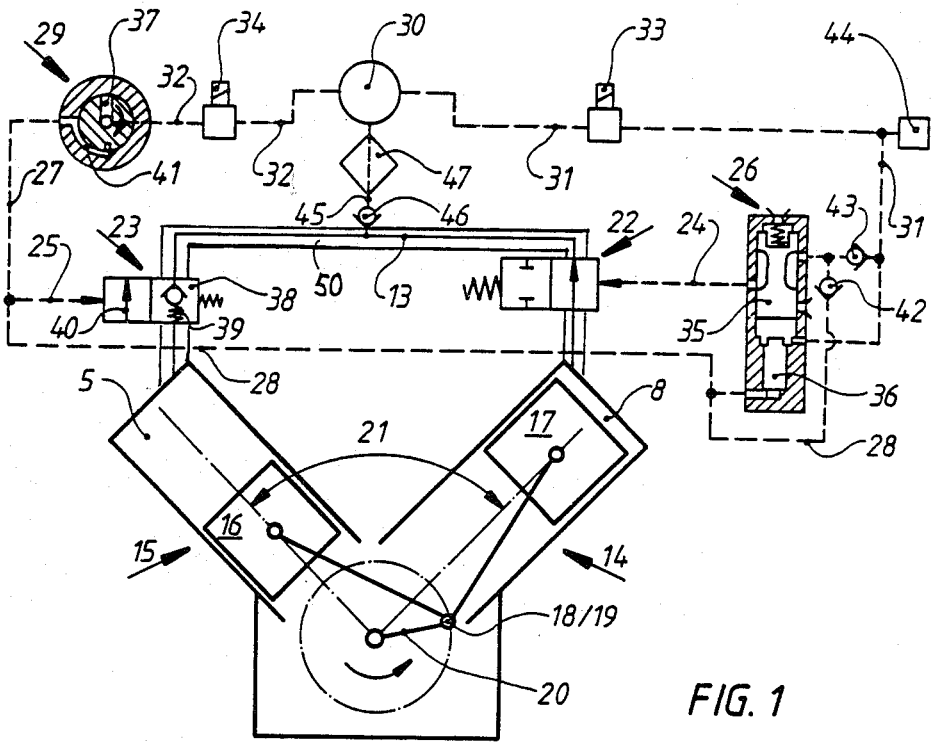

MULTI-CYLINDER DIESEL INTERNAL COMBUSTION ENGINE WITH LOW COMPRESSION RATIO IN THE CYLINDERS

DESCRIPTION

The invention relates to a multi-cylinder diesel internal combustion engine with low compression ratio in the cylinders wherein during normal engine operation, all cylinders are supplied with fuel and produce power output and wherein during starting and possibly at partial load a so-called divided engine operation is obtained, wherein some cylinders operate as compressors without fuel supply for supplying compressed air to the other cylinders that operate as an engine. Here one compressor cylinder is connected with a respective engine cylinder by way of a line, independent of the normal suction and exhaust lines. This independent line includes at its one end, in the proximity of the compressor cylinder, a donor valve adapted to be controllably opened in the divided operation. At its other end, in the proximity of the engine cylinder, the independent line includes a receiver valve closing in the direction of the compressor cylinder. The piston of each compressor cylinder leads the piston of the coordinated engine cylinder by 30° to 150° crankshaft angle.

With such an arrangement, an improved supply of the cylinders operating as engine with precompressed combustion air is effected so that in the divided operation of the diesel internal combustion engine, the required compression end temperature for the ignition of the injected fuel is reached in the cylinders operating as engine notwithstanding a low compression ratio.

A diesel internal combustion engine of this type is known from the DE-PS No. 26 48 411. With divided operation of the diesel internal combustion engine, the cylinders operating as compressor remain cold in relation to the temperature of an engine cylinder. This effect results from the transfer of the air which is compressed in the compressor cylinder and heated thereby, to an engine cylinder and the subsequent sucking-in of air which has a lower temperature than the transferred compressed air. It has been found thereby that the cooling off of the compressor cylinders resulting from the air mass loss is not compensated by the heat supply from the cooling system.

During the transition from divided to full engine operation, ignition problems result therefore with the compressor cylinders because the compression end temperature is reached only after a warm-up phase of the respective cylinder. A rapid load acceptance of the diesel internal combustion engine is prevented thereby. It is therefore task of the invention to avoid in a diesel internal combustion engine of this type the cooling off of the cylinder interior spaces in the cylinders operated as compressors.

This task is solved according to the invention by having each of the receiver valves combined with a device for opening each respectively associated independent line in the direction toward the compressor cylinder and wherein control of the independent line takes place during the exhaust stroke of the coordinated engine cylinder and wherein a pulse for the actuation of the device is derived from an energy storage device by a distributor in dependence on engine crankshaft rotational speed. The arrangement effects an exhaust gas return from the engine cylinders into the compressor cylinders. As a result thereof, a temperature increase in the compressor cylinders is attained with divided operation of the diesel internal combustion engine. The same lines are used for the exhaust gas return which are already present in the diesel internal combustion engine for the transfer of the compressed air from the compressor cylinders. A further refinement is obtained wherein a change-over control slide valve is arranged in a control line of the donor valve and which is constructed to be acted upon by two differing actuating pulses. The energy storage device is a compressed air accumulator which is fed from at least one of the independent lines by way of a check valve.

It is further advantageous, if the multi-cylinder diesel internal combustion engine independent lines are encased with heat-insulating material.

The advantages achieved with the invention reside in particular in that with divided operation of the diesel internal combustion engine, air with higher temperature is available from the compressor cylinders for the additional charging of the engine cylinders than without exhaust gas return, in that during transition to full engine-operation, the diesel internal combustion engine permits an immediately starting load increase up to the full load limit, and in that the diesel internal combustion engines already constructed for the divided operating manner can be equipped without problem with the arrangement according to the invention.

Figure 2:
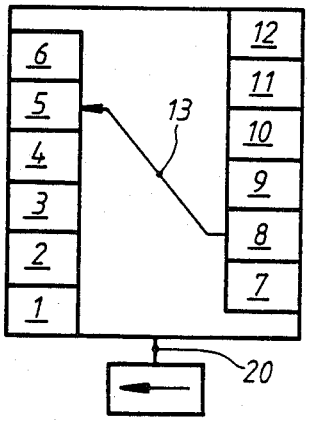

One embodiment of the invention is illustrated in the drawing and will be described more fully hereinafter. It shows:

FIG. 1 schematic arrangement of two cylinders of a diesel in engine with additional charging arrangement;

FIG. 2 schematic arrangement of the cylinders of FIG. 1 in cylinder rows of the diesel internal combustion engine.

A diesel internal combustion engine with V-shaped twelve cylinders 1 to 12 arranged in two rows is schematically illustrated in FIG. 2. The ignition sequence is assumed to be 1-8-5-10-3-7-6-11-2-9-4-12. In the example with so-called divided operation, the cylinders 1 to 6 of the first row are used as engine cylinders, the cylinders 7 to 12 of the second row as compressor cylinders in the starting- and partial load operation. The cylinders 8 and 5, 10 and 3, 7 and 6, 11 and 2, 9 and 4 and 12 and 1 are each connected by a line. In FIG. 2, only the line between cylinder 8 and cylinder 5 is illustrated designated with reference numeral 13. The line 13 can be encased in heat-insulating material shown schematically at 50. Of course, it is also possible to subdivide only a par of the existing cylinders into engine and compressor cylinders. Similarly, with corresponding ignition sequence, the two associated cylinders can be arranged in the same row.

A compressor cylinder 14 having the cylinder 8 and a piston 17, an engine cylinder 15 having the cylinder 5 and a piston 16 as well as the associated line 13 with control elements is illustrated in FIG. 1.

The position of two crank pins 18, 19 of a crankshaft indicated with 20 coincides for both pistons 16, 17. From the V-angle 21 of the cylinder arrangement illustrated with 90° results a leading of the piston 17 of the compressor cylinder 14 of also 90° crankshaft angle with respect to the piston 16 of the engine cylinder 15. The piston 17 of the compressor cylinder is shortly before its upper dead-center position and has compressed the air quantity previously sucked-in by the same. The piston 16 of the engine cylinder is located shortly after its lower dead-center point and therewith at the beginning of its compression stroke.

Each of the lines 13, which is arranged between a cylinder pair, is controlled by two valves. The one, so-called donor valve 22 which is located in proximity of the compressor cylinder 8, is actuated in unison with a fuel closure valve 44 for the compressor cylinders 7 to 12 by way of a control line 31.

The other, so-called receiver valve 23 which is located in proximity of the engine cylinder 5 is connected together with the changeover slide valve 26 with a compressed air distributor 29 by way of control lines 25, 27, 28. The supply of the control system with compressed air takes place from a compressed air accumulator 30 which is connected with the changeover slide valve 26, respectively, with the compressed air distributor 29 by way of one line 31 and 32 each. The lines 31, 32 are thereby controlled by solenoid valves 33, 34.

With divided operation of the diesel internal combustion engine, the solenoid valves 33, 34 in the line 31 and 32 are opened. The compressed air from line 31 reaches a changeover slide valve 26 and displaces the slide valve member 35 thereof into the passing position (as illustrated). Compressed air therewith reaches from line 31 by way of line 24 the donor valve 22 which is displaced thereby into the illustrated position. The line 13 is opened therewith. As simultaneously also the solenoid valve 34 in the line 32 is opened, compressed air also reaches the compressed air distributor 29 whose distributor rotor 37 rotates with one-half the crankshaft rotational speed. The position of the distributor rotor 37 is coordinated to the position of the associated piston 16 of cylinder 5. In the illustrated position of piston 16 at the beginning of the compression stroke, the passage between line 32 and 27 is closed at the compressed air distributor 29. The receiver valve 23 is therefore in the position illustrated in FIG. 1. A valve 38 arranged in the receiver valve 23 is thereby operable which is opened against the force of a spring 39 by the pressure of the air compressed in the cylinder 8. The instant of time of the air transfer from cylinder 8 to cylinder 5 and the pressure level during the compression beginning in cylinder 5 is determined with the design of the valve 38.

After one crankshaft rotation, the piston 16 of the engine cylinder 5 at the beginning of the exhaust stroke is again in the lower dead-center position and the piston 17 of the compressor cylinder 8 at the beginning of the suction stroke in the upper dead center position. This position of the pistons 16, 17 corresponds approximately also to the illustration in FIG. 1. Only with the difference that the distributor rotor 37 of the compressed air distributor 29 has assumed a position displaced by 180°. As a result thereof, the passage between line 32 and 27 is now opened. The compressed air therewith reaches control line 25 and displaces the receiver valve 23 into its other position whereby the passage 40 becomes operable. Hot exhaust gas flows now during the exhaust stroke from cylinder 5 to the cylinder 8 which at the same time carries out a suction stroke. The air sucked-in by way of the regular inlet valve thereby mixes in cylinder 8 with the hot exhaust gas arriving by way of line 13. A warm-up of the compressor cylinder 14 and of its filling quantity results therefrom. Duration and starting point in time of this exhaust gas return is determined by the position and length of the control groove 41 at the compressed air distributor 29. As soon as the distributor rotor 37 has reached the end of the control groove 41, the compressed air to the receiver valve 23 is blocked and the lines 27 vented. The receiver valve 23 returns again into the position illustrated in FIG. 1 in which the valve 38 is effective.

During the divided manner of operation of the diesel internal combustion engine, the donor valve 22 is continuously opened whereas the receiver valve 23 moves to and fro between its two positions at the rhythm of the exhaust strokes of the engine cylinder 15. During the transition from divided operation to full engine operation, it is desirable for the improvement of the load acceptance of the cylinders previously operated as compressors to continue the exhaust gas return by way of line 13 for a given time. For this purpose, only the solenoid valve 33 is closed. The blocking of the compressed air supply effects the shifting of the donor valve 22 into its closing position and the release of the fuel supply to the cylinders 7 to 12. The solenoid valve 34 still remains opened. As a result thereof, the lines 25, 27, 28 are periodically supplied with compressed air by compressed air distributor 29 as described above. Compressed air also reaches by way of line 28 the changeover slide valve 26 underneath the differential piston 36. As the space underneath the slide valve member 35 is now without pressure after closing of solenoid valve 33, the piston area of differential piston 36 is sufficient in order to displace the slide valve member 35 into the position illustrated in FIG. 1. The compressed air existing in line 28 now opens the check valve 42, closes the check valve 43 and reaches the donor valve 22 by way of slide valve member 35. The donor valve 22 is now displaced by means of the pulses coming from the compressed air distributor 29 into its passing position during approximately the duration of the exhaust stroke of cylinder 5 so that in each case exhaust gas can flow from the cylinder 5 by way of line 13 into the cylinder 8. This exhaust gas return is terminated when by de-energizing the solenoid valve 34, the compressed air supply from the compressed air accumulator 30 to the compressed air distributor 29 is interrupted.

A line 45 leading to the compressed air accumulator 30 is connected at least to one of the lines 13 by way of a check valve 46, which serves for the refilling of the compressed air accumulator. A filter 47 is arranged in the line 45 for cleaning the compressed air.

I claim:

1. A multi-cylinder diesel internal combustion engine with relatively low compression ratio in its cylinders, in which all cylinders are supplied with fuel during normal operation and are operable to produce power output while during the starting and possibly during partial load some of the cylinders operate in the so-called divided operation as compressors operable to supply compressed air to the cylinders operating as engine, and in which a respective compressor cylinder is operatively connected with a respective engine cylinder by way of a line manes independent of customary suction and exhaust lines, said line means including at its one end in proximity of the respective compressor cylinder a donor valve means operable to be controllably opened in the divided operation and at its other end in proximity of the respective engine cylinder a receiver valve means closing in the direction to the respective compressor cylinder, the piston of each compressor cylinder leading the piston of the coordinated engine cylinder by about 30° to 150° of crankshaft angle, each donor valve means being operatively combined with a control means for the selective opening of the respectively associated line means in the direction toward the corresponding compressor cylinder, the opening control of the line means by the control means taking place during the exhaust stroke of the associated engine cylinder, and distributor means operable to produce a pulse for the actuation of the control means from an energy storage means, said distributor means being operable in dependence on the crankshaft rotational speed.

2. A multi-cylinder diesel internal combustion engine according to claim 1, wherein said donor valve means includes a control line and wherein the control means includes a changeover slide valve means being arranged in said control line which is operable to be acted upon by two different actuating pulses.

3. A multi-cylinder diesel internal combustion engine according to claim 5, wherein said energy storage means is a compressed air accumulator which is fed from at least one of the independent line means by way of a check valve.

4. A multi-cylinder diesel internal combustion engine according to claim 1, further comprising heat-insulating material surrounding said line means.

5. A multi-cylinder diesel internal combustion engine according to claim 2, wherein said energy storage means is a compressed air accumulator which is fed from at least one of the independent line means by way of a check valve.

6. A multi-cylinder diesel internal combustion engine according to claim 5, further comprising heat-insulating material surrounding said line means.

* * * * *